US005369847A

United States Patent [19]

Naya et al.

[11] Patent Number: 5,369,847

[45] Date of Patent: Dec. 6, 1994

[54] FLEXIBLE FASTENER

[75] Inventors: Masahiro Naya, Kariya; Tsutomu Hamatani, Namerikawa, both of Japan

[73] Assignee: Yoshida Kogyo K.K., Tokyo, Japan

[21] Appl. No.: 32,294

[22] Filed: Mar. 17, 1993

[30] Foreign Application Priority Data

Mar. 25, 1992 [JP] Japan ..... 4-025427[U]

[51] Int. Cl.[5] ..... B65D 33/16

[52] U.S. Cl. ..... 24/30.50 R; 24/576; 24/587; 383/65

[58] Field of Search ..... 24/587, 576, 399, 400, 24/305 R; 383/63, 64, 65

[56] References Cited

U.S. PATENT DOCUMENTS 4,363,345 12/1982 Scheibner .
5,065,899 11/1991 Tilman ..... 24/576
5,209,574 5/1993 Tilman ..... 24/587

FOREIGN PATENT DOCUMENTS 89680 9/1983 European Pat. Off. ..... 383/65
0220476 5/1987 European Pat. Off. .
0273327 7/1988 European Pat. Off. .
3-19313 2/1991 Japan .

*Primary Examiner*—Edward K. Look
*Assistant Examiner*—James A. Larson
*Attorney, Agent, or Firm*—Hill, Steadman & Simpson

[57] ABSTRACT

A flexible fastener comprises a pair of opposed fastener strips each including a base plate; and a longitudinal marginal grip portion integrally formed along one longitudinal edge thereof. A pair of opposed female and male coupling portion are mounted on the inner sides on the base plates so as to project toward each other to coming into coupling engagement with each other, thereby releasably join the opposed fastener strips. Two pairs of elongated ridges are provided on the inner sides of the fastener strips, and a pair of elongated ridge are provided on the outer sides of fastener strips so as to provide increased friction between fingers and the fastener strips.

8 Claims, 2 Drawing Sheets

FLEXIBLE FASTENER

BACKGROUND OF THE INVENTION

1. Field of the Invention

The present invention relates generally to a flexible fastener attached to a mouth edge of a bag, a pouch and the like and functions to open and close the mouth edge.

2. Description of the Prior Art

A typical flexible fastener of the type described is disclosed in Japanese Utility Model Laid-open Publication No. 3-19313. The disclosed flexible fastener comprises a pair of opposed fastener strips having on their respective inner sides a male and a female locking portion for coupling engagement with each other and having their opposed marginal grip portions diverged outward to facilitate grip and manipulation. In order to further facilitate grip, the opposed marginal grip portions are provided at their edges with bulges. For opening the flexible fastener, the opposed marginal grips are gripped and spread apart.

However, the above-mentioned conventional flexible fastener suffers from drawbacks. In the conventional flexible fastener, the bulges are located at the very extremities of the grip portions. On the other hand, far inner parts of the grip portions are gripped by fingers for opening the fastener which are flat and have less friction. Since being made of synthetic resinous film, the flexible fastener is very slippery. This requires tight and forcible grip of the grip portions for opening the fastener which is not a problem where the fastener is opened only a few times. However, there are some circumstances which require one person to open thousands of flexible fasteners repeatedly such as a worker in a grain factory. The worker is likely to have a pain or paralysis of the fingers.

SUMMARY OF THE INVENTION

With the foregoing difficulties in view, it is therefore an object of the present invention to provide a flexible fastener wherein, for opening the fastener, the inner surface of fingers can touch the grip portion of the flexible fastener over a wider area, to thus provide increased friction.

According to the present invention, there is provided a flexible fastener comprising a pair of opposed fastener strips each strip including a base plate; a longitudinal marginal grip portion integrally formed along one longitudinal end thereof; one member of a pair of opposed female and male coupling portions mounted on the inner sides on the base plates so as to project toward each other for coming into coupling engagement with each other, thereby releasably joining the opposed fastener strips; one member of a pair of opposed distal inner ridges provided longitudinally on the inner sides of the opposed fastener strips along the edges of the marginal grip portions, respectively; one member of a pair of proximal inner ridges provided longitudinally along the inner sides of the fastener strips and disposed on the grip portion between the respective distal inner ridge and the respective female or male coupling portion, respectively; and one member of a pair of opposed outer ridges provided on the outer sides on the marginal grip portions and each disposed between the distal inner ridges and the proximal inner ridges, respectively.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
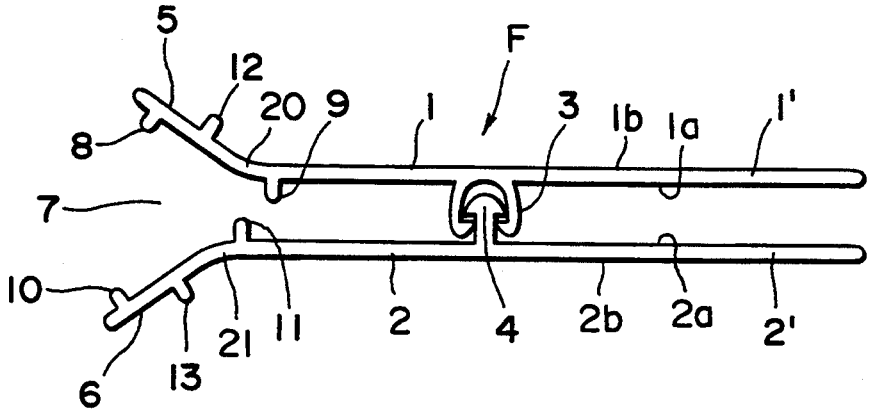
FIG. 1 is a side view of a flexible fastener according to the present invention.

FIG. 1 shows a flexible fastener F according to the present invention. The flexible fastener F is made of synthetic resin and broadly comprises a pair of elongated fastener strips 1, 2 opposed in surface-to-surface relation to each other. Each of the fastener strips 1, 2 generally comprises a base plate 1', 2' and a longitudinal marginal grip portion 5, 6 integrally formed therewith and joined along a junction 20, 21. A pair of opposed elongated female and male coupling portion 3, 4 are integrally mounted longitudinally on the respective inner sides 1*a*, 2*a* of the base plates 1', 2' so as to project toward each other. The female coupling portion 3 is of C-shaped cross-section while the male coupling portion 4 is of arrow-shaped cross-section and is adapted for snap engagement with the C-shaped female coupling portion 3. The opposed fastener strips 1, 2 are releasably joined together by resiliently coupling the female and male coupling portions 3, 4, respectively.

As shown in FIG. 1, the grip portion 5, 6 of the opposed fastener strips 1, 2 are diverged toward their respective edges, thereby providing an ample space 7 for letting thumbs in between the opposed marginal grip portions 5, 6.

A pair of opposed elongated distal inner ridges 8, 10 are provided along the edges of the inner sides 1*a*, 2*a* of the marginal grip portions 5, 6, respectively. Likewise, a pair of elongated proximal inner ridges 9, 11 are provided longitudinally on the inner sides 1*a*, 2*a* of the fastener strips 1, 2 and disposed along the junctions 20, 21, respectively. Furthermore, a pair of opposed elongated outer ridges 12, 13 are provided on the outer sides 1*b*, 2*b* on the marginal grip portions 5, 6 and each disposed between the distal inner ridges 8, 10 and the proximal inner ridges 9, 11, respectively. In this embodiment, one marginal grip portion 5 is formed shorter than the other grip portion 6. And, the proximal inner ridges 9, 11 are out of registry with each other.

The flexible fastener F of the construction set forth hereinabove is attached to a mouth edge 15 of a pouch 14 or the like by adhering or otherwise fastening the opposed fastener strips 1, 2 along their respective inner edges to the mouth edge 15 of the pouch 14, as better shown in FIG. 3.

For closing the flexible fastener F, the opposed fastener strips 1, 21 are compressed until the female and male members 3, 4 on the inner sides 1*a*, 2*a* of the fastener strips 1, 2, respectively come into coupling engagement with each other, so that the fastener F and hence the pouch 14 is closed.

Figure 3:
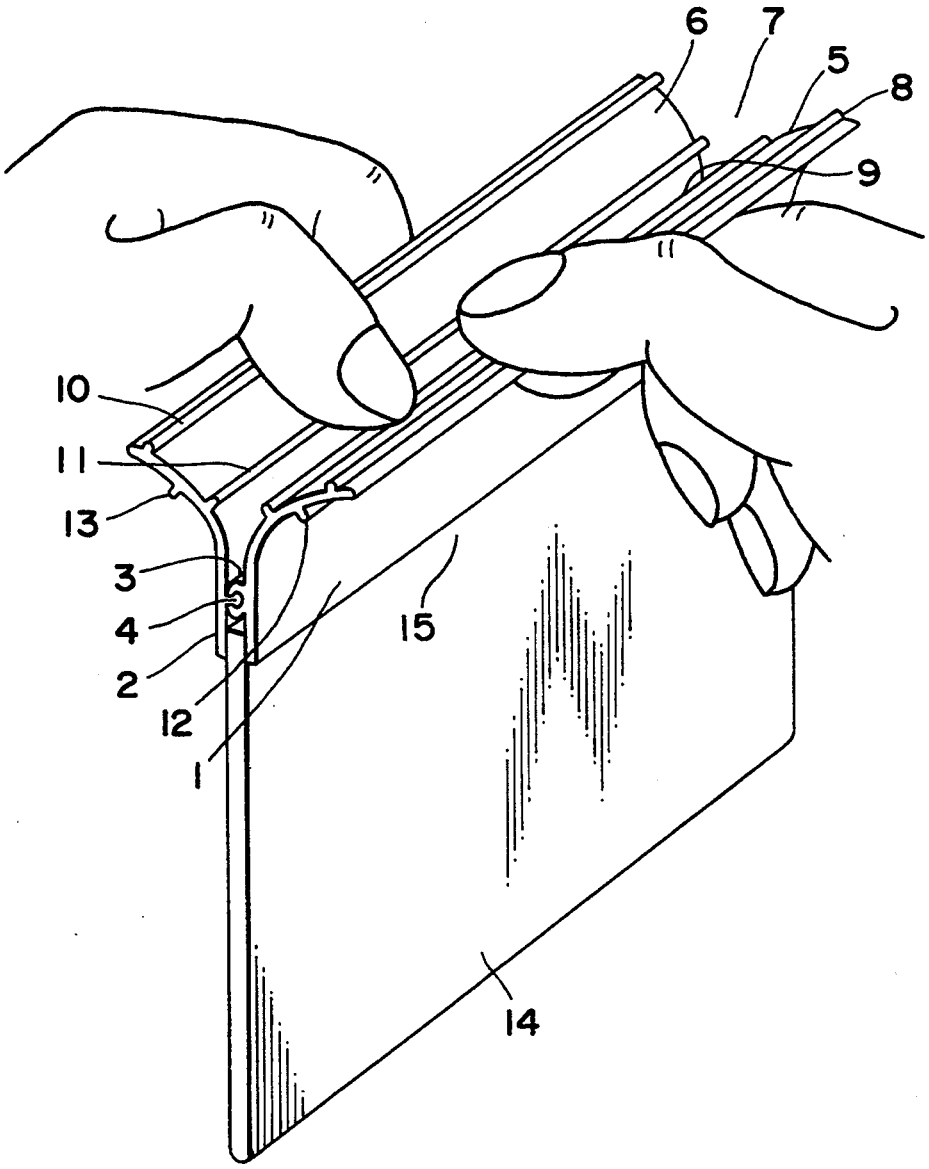
FIG. 3 is a prospective view showing the flexible fastener of FIG. 1 in use.

For opening the flexible fastener F, as better shown in FIG. 3, both thumbs are wedged into the space 7 between the opposed marginal grip portions 5, 6. Then, the marginal grip portions 5, 6 are gripped by the thumbs and the forefingers and spread apart until the female and male coupling portions 3, 4 come out of coupling engagement with each other, so that the fastener F and hence the pouch 14 are opened. In this event, the inner surfaces of the thumbs are embedded in the marginal grip portions 5, 6; to be specific, they touch as wide as both distal and proximal ridges 8, 10; 9, 11 and the inner sides 1*a*, 2*a* of the marginal grip portions 5, 6 interposed between the ridges 8, 10; 9, 11. And, the forefingers engage the outer ridges 12, 13. This provides increased frictional resistance between the fingers and fastener strips 1, 2 and thus ensures that fingers can make a very firm grip on the fastener strips 1, 2, even less force applied thereto. Consequently, even repeated opening and closing operation of the fastener F would never cause a pain or paralysis on fingers.

Figure 2:
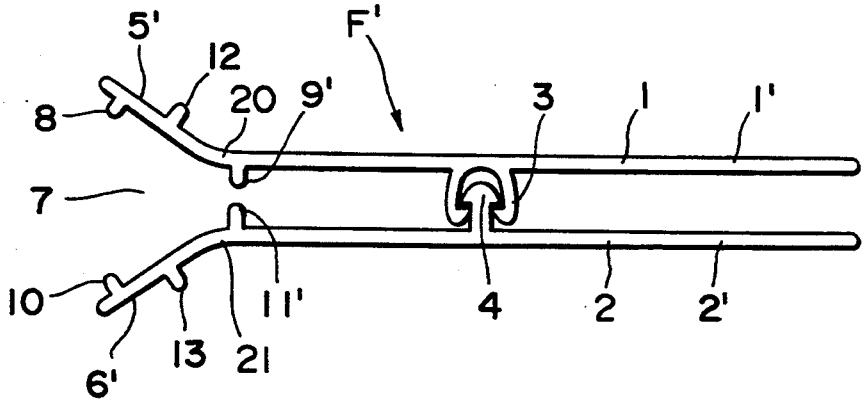
FIG. 2 is a view similar to FIG. 1 but showing another embodiment of the present invention.

FIG. 2 shows a flexible fastener F′ according to another embodiment of the present invention. The flexible fastener F′ is substantially identical with the flexible fastener F according to the preceding embodiment except that the opposed longitudinal marginal grip portions 5′, 6′ are the same in length and that the proximal inner ridges 8, 9 are fight in registry with each other.

With the construction set forth hereinabove, fingers can make a very firm grip on the fastener strips 1, 2, when opening the fastener: nevertheless, even repeated opening and closing operation of the fastener will never cause a pain or paralysis on fingers.

Obviously, the skilled person would realize that various modifications and variations of the present invention are possible in the light of the above teaching. It is therefore to be understood that within the scope of the appended claims the invention may be practiced otherwise than as specifically described, and that the invention is not limited to the .embodiments described above in detail.

What is claimed is:

1. A flexible fastener comprising a pair of opposed fastener strips each including;

a base plate;

a longitudinal marginal grip portion integrally formed along one longitudinal edge of the plate;

one of a pair of opposed female and male coupling portions mounted on the inner side on the base plate so as to project toward each other for coming into coupling engagement with each other, thereby releasably joining the opposed fastener strips;

one of a pair of opposed distal inner ridges provided longitudinally on the inner sides of the opposed fastener strips along the edges of the marginal grip portions, respectively;

one of a pair of proximal inner ridges provided longitudinally along the inner sides of the fastener strips and disposed between the distal inner ridges and the female and male coupling portions, respectively; and one of a pair of opposed outer ridges provided on the outer sides on the marginal grip portions and each disposed between the distal inner ridges and the proximal inner ridges, respectively.

2. A flexible fastener according to claim 1, the longitudinal marginal grip portions of the opposed fastener strips being diverged towards their edges.

3. A flexible fastener according to claim 1, the proximal inner ridges running along junctions defined between the base plates and the longitudinal marginal grip portions, respectively.

4. A flexible fastener according to claim 1, the proximal inner ridges of the opposed fastener strips being out of registry with each other.

5. A flexible fastener comprising a pair of opposed fastener strips, comprising:

first and second base plates;

first and second longitudinal marginal grip portions extending from said first and second base plates respectively;

a female coupling portion mounted on an inner side of said first base plate;

a male coupling portion mounted on an inner side of said second base plate, said female and male coupling portions arranged to project toward each other for coming into coupling engagement with each other to releasably join the opposed fastener strips;

first and second opposed distal inner ridges arranged longitudinally on inner sides of the opposed fastener strips along edges of said first and second marginal grip portions respectively;

first and second proximal inner ridges arranged longitudinally along inner sides of the first and second fastener strips and arranged between the distal inner ridges and the female and male coupling portions, respectively;

first and second opposed outer ridges arranged on outer sides of said marginal grip portions and each disposed between said first and second distal inner ridges and said first and second proximal inner ridges, respectively; and said inner and outer side of said marginal grip portions between said distal inner ridges and said proximal inner ridges comprise smooth surfaces compared to heights of the distal and proximal inner ridges on the inner side and a height of the outer ridges on the outer side.

6. A flexible fastener according to claim 5, wherein the longitudinal marginal grip portions of the opposed fastener strips are diverged towards their edges.

7. A flexible fastener according to claim 5, wherein the proximal inner ridges run along junctions defined between the base plates and the longitudinal marginal grip portions, respectively.

8. A flexible fastener according to claim 5, wherein the proximal inner ridges of the opposed fastener strips being out of registry with each other.

* * * * *